United States Patent [19]

Mulot et al.

[11] Patent Number: 4,466,417

[45] Date of Patent: Aug. 21, 1984

[54] MAGAZINE FOR UNDERWATER CROSSBOW STRING FUNCTIONING BY DEPRESSION

[76] Inventors: Georges Mulot; Suzette Mulot nee Crubilhe, both of 152, rue Paul Doumer, 78.420 Carrieres S/Seine, France

[21] Appl. No.: 342,758

[22] Filed: Jan. 26, 1982

[30] Foreign Application Priority Data

Jan. 27, 1981 [FR] France ..... 81 01429

[51] Int. Cl.[3] ..... F41B 5/00

[52] U.S. Cl. ..... 124/25; 124/80; 43/6

[58] Field of Search ..... 124/25, 27, 41 R, 41 C, 124/83, 22, 80; 43/6

[56] References Cited

U.S. PATENT DOCUMENTS 1,133,189 3/1915 Shannon ..... 124/25
2,779,323 1/1957 Thomsen ..... 124/83 X
3,139,692 7/1964 Sellers et al. .
3,142,293 7/1964 Harter ..... 124/22 X
3,340,642 9/1967 Vasiljevic ..... 124/22

FOREIGN PATENT DOCUMENTS 888374 12/1943 France .
1139692 10/1969 United Kingdom .

*Primary Examiner*—Richard J. Apley
*Assistant Examiner*—William R. Browne
*Attorney, Agent, or Firm*—Sandler & Greenblum

[57] ABSTRACT

Magazine for an immersed underwater crossbow containing a string and allowing for the rapid introduction by suction of the string and its natural arrangement by means of retracting means as well as its exit without difficulty.

By pulling on the shank of the piston pump, a depression is produced within the magazine and the string rapidly enters the magazine across its end and, arranges itself naturally against the piston.

One can thus arrange several meters without difficulty. The exit is accomplished in the same way.

11 Claims, 10 Drawing Figures

FIG. 6
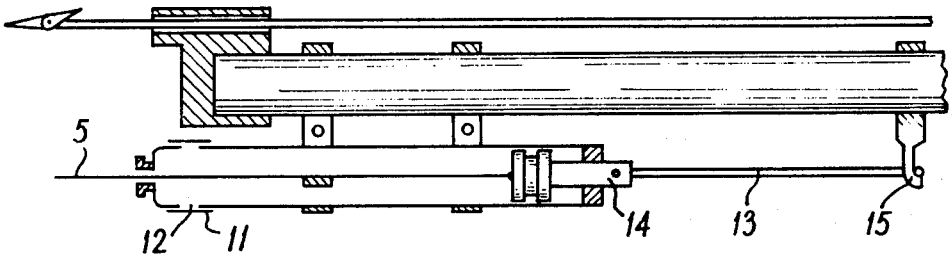
FIG. 7
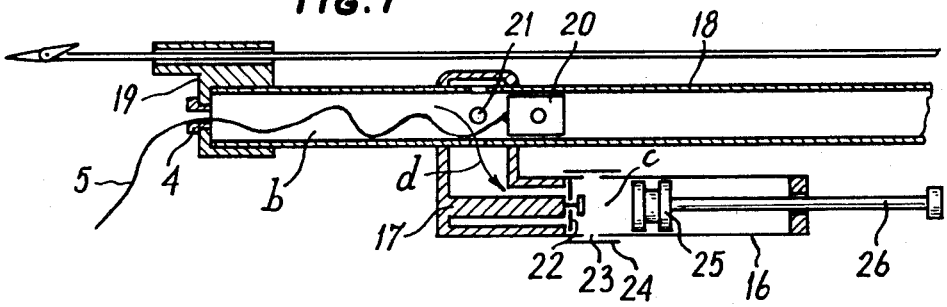
FIG. 8
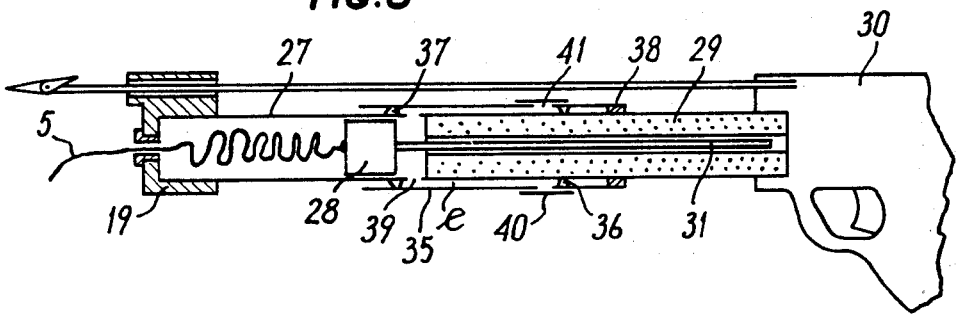
FIG. 9
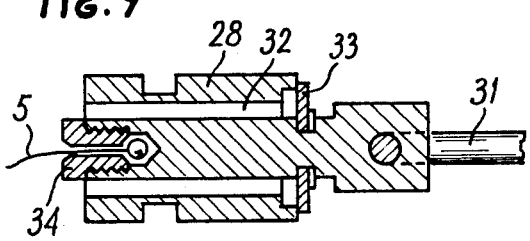
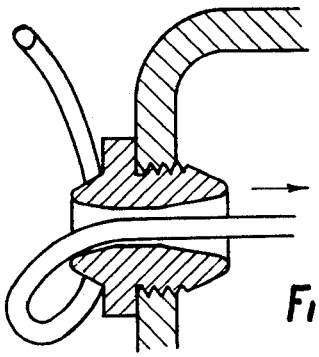
FIG. 10

MAGAZINE FOR UNDERWATER CROSSBOW STRING FUNCTIONING BY DEPRESSION

BACKGROUND OF THE INVENTION

1. Field of the Invention

The present invention comprises an immersed underwater crossbow comprising a string connected at one end to the projectile of the crossbow, and at the other end to a retracting means. After the projectile is fired, suction caused by retraction provides for withdrawal of the string.

2. Description of the Prior Art

An underwater crossbow is distinguished from most other weapons by the indispensable presence of a string connecting the weapon proper with its projectile, the arrow. This is indispensable so as not to lose the latter.

When the weapon is ready to use, this string is generally arranged along the tube of the gun and maintained either by collars or elastic clips, or, in a more elaborate version hooked to a transversal stop which is retracted when the arrow is fired thus freeing the said string.

Other retracting solutions exist employing rolling drums or rewinding by elastic thread.

All the solutions utilized must accommodate to the presence of water which is more or less troublesome.

SUMMARY OF THE INVENTION

The object of the present invention is the provision of apparatus that utilizes this surrounding water environment.

The invention utilizes the suction created by the depression of a piston pump to generate water inflow with accompanying string.

The important features of the apparatus may be summarized as follows:

- the rapid introduction in a magazine of the string hooked to the interior across a hollow end.
- the organized arrangement of the string which aligns itself naturally in the magazine cylinder.
- the total protection of the string once aligned or arranged.
- the exit without constraint of the string when the arrow is shot.
- the absence of the formation of a tangle which prevents its exit.

To these principal characteristics are added those of the various embodiments.

BRIEF DESCRIPTION OF THE DRAWINGS

FIG. 6 describes a modification containing a short piston and elastic holder 13.

FIG. 7 describes the cylinder integrated with the crossbow.

FIG. 8 combines the apparatus of FIGS. 6 and 7.

FIG. 9 describes the apparatus with a modified piston.

FIG. 10 shows the endpiece 4 in enlarged form.

DESCRIPTION OF PREFERRED EMBODIMENTS OF THE INVENTION

Figure 1:
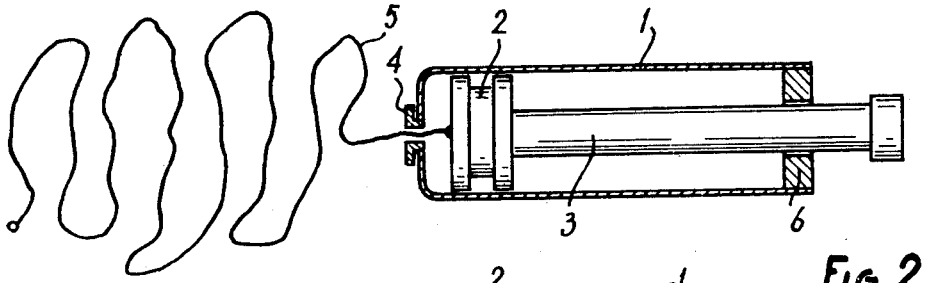
FIGS. 1–3 describe the apparatus of the invention in its simplest form.
Figure 2:
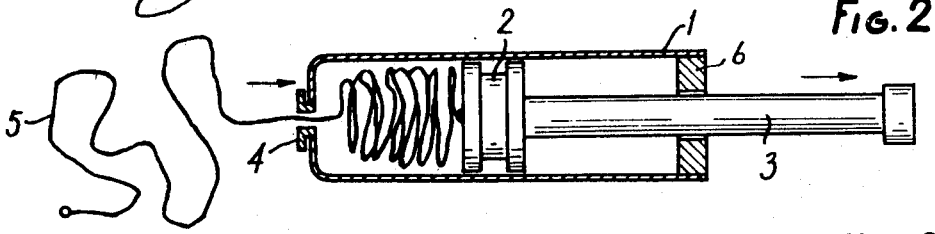

In FIG. 1; a blind cylinder 1, can slide a piston 2 whose shank 3 is sufficiently long to be maneuverable. At the base of the cylinder is attached a hollow end piece 4 whose bore, at its minimum diameter, is slightly higher than the diameter of the string 5, which is flexible and of the roundest cross section possible, and is tied to the end of the piston 2. The longitudinal extent of this piston is limited by the retention ring 6 attached to the cylinder 1. The whole device is immersed in liquid. When the string has completely left the whole device represented by the FIG. 1, the piston 2 is pushed to the base of the cylinder. When one pulls on the shank 3 with a sufficiently rapid movement to retract the piston, the water passes with great speed into the bore of the endpiece 4 in direct relation to the ratio of the cross section of the cylinder and of the cross section of the passage of the endpiece. The suction of the liquid is such that the string is dragged with less speed but sufficiently high so that, halfway through its course, a large portion of the string is piled up against the piston (FIG. 2).

This principle of dragging is known and utilized continuously in textile machines, the medium generally being air. The originality of the invention concerns the use of this principle for the purpose of string storage.

Figure 3:
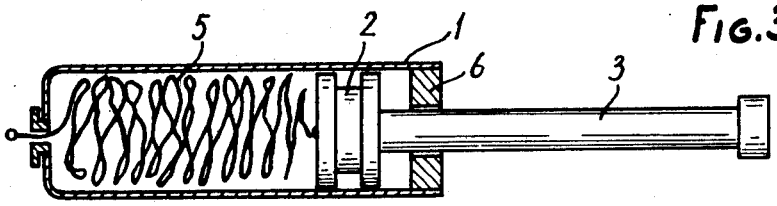

The FIG. 3 shows the end of the operation. All of the string has returned in the cylinder. When one pulls on the string, it exits without making a knot. In fact, the string during introduction, arranges itself avoiding all spiralling by the successive formation of alternating spirals and figure-eights, obviously more or less regularly. This natural arrangement will provide for future evacuation without constraint.

The apparatus has been described above in its simplest form. It should be appreciated by the above, if one pushes the shank hard, the string leaves at top speed and is projected far from the cylinder, dragged strongly by the water shot out by the action of the piston.

In the apparatus of FIGS. 1–3 the phenomena of suction and of expulsion are both used.

Figure 4:
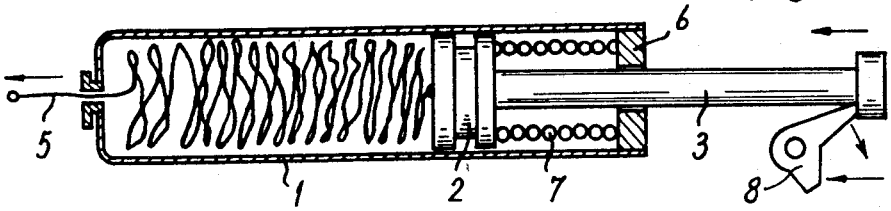
FIG. 4 describes an embodiment containing a spring 7 to restrain the piston pump.

FIG. 4 shows a more sophisticated apparatus where the piston 2 and the shank 3 retracted by forcing against an elastic element, a spring 7, for example. The end of the shank is maintained in this extreme position by a catch 8. This catch 8 is, by an apparatus not shown and which can be realized in numerous fashions; connected to the sear of the crossbow.

When the trigger activates the sear, the catch 8 liberates the shank 3, the string is ejected at the same time that the arrow is fired. The cylinder 1 is attached parallel to the tube of the crossbow, the endpiece 4 finding itself positioned as much as possible at the head thereof so that the string is minimally exposed; the attachment can be accomplished for example by double collars 10 as illustrated in FIG. 5.

Figure 5:
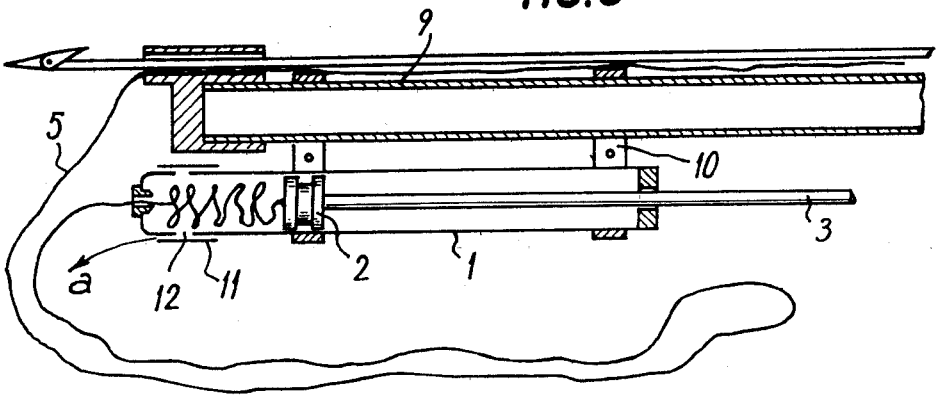
FIG. 5 describes an apparatus which is provided with valve 11 enlarging the area for water outflow.

FIG. 5 represents another version.

The cylinder 1 is attached to the tube 9 of the crossbow by two special collars 10. A very weak firing catch, for example made up of a very flexible rubber valve ring 11 encircling the end of cylinder 1, contains several holes 12 to let water pass in the direction (a) and to be blocked in the other direction.

When one pulls on the shank 3 all proceeds as if there were not any holes 12 and the string is drawn in. When one pushes the shank again, the water passes by preference through the holes 12 and the string does not go out.

The valve 11 has two advantages:

(a) When, after the release of an arrow, the string has exited, one must not exert force on the shank to flush the water through the orifice of the endpiece 4; the water exits easily through the holes 12.

(b) If following a firing incident all of the string is not returned to the cylinder, one can, after having pushed the piston again a bit, fire it again to activate the apparatus.

The preceding arrangement can be used as shown in FIG. 6 in conjunction with the action of an elastic holder 13 hooked to a short piston 14 and a hook 15 attached to the crossbow.

Instead of maneuvering the shank of the piston, one pulls on the string 5 to bring the piston to the base of the cylinder. This movement is facilitated by the free exit of water through the holes 12. Next, one releases the string that when liberated, is drawn in by the water during the displacement of the piston recalled briskly by the holder 13.

The preceding apparatus are in fact accessories and this are able to be mounted on a commercial crossbow.

The apparatus according to FIG. 7 on the other hand corresponds rather to an apparatus integrated in a crossbow.

The cylinder 16 is attached by a double hollow support 17 to the tube 18 of the crossbow on which is attached the head 19. A stopper 20, to which is attached the string 5, is immobilized in the tube 18. The chamber (b) thus constituted communicates by the holes 21 with the chamber C of the cylinder 16 across a flexible valve for example which does not let water pass through in the direction (d).

Around cylinder 16, pierced by the holes 23, a flexible ring 24 serves as a valve and does not permit the exit of the water.

Pushing the piston 25 by the shank 26 empties the chamber C. By pulling on the shank 26, water is drawn in across the valve 22 and the endpiece 4 attached on the head 19. The string dragged by the water arranges itself in the chamber (b). The maneuver can be repeated if the operation is not finished or has been disturbed.

FIG. 8 combines the apparatus according to FIGS. 6 and 7.

In the tube 27 of the crossbow slides the short piston 28 whose extent is limited by the head 19 of the crossbow and the inner tube 29 that can be made of a very light material hooked to the butt 30. The string 5 is hooked to the piston 28 which is recalled from behind by the elastic holder 31.

The piston 28 (FIG. 9) is for example pierced by holes 32 and equipped with a flat valve 33 made of a flexible material maintained by a throat of the piston closing itself when the holder is activated but letting water pass through when one pulls on the string 5 maintained by the hollow screw 34. An exterior annular cylinder 35 is mounted around the tube 27. A joint 36 integral with cylinder 35 and a joint 37 mounted on the tube 27 closes the chamber (e) thus constituted. The ring 38 defines the end of the course of the cylinder 35.

Pulling on the string brings the piston to the end of the course, the movement not being disturbed due to the valve 33. When the string is released this valve 33 closes itself, the piston draws in water across the endpiece 4, the water in the chamber (e), as such, confined in the tube 27 by the valve 33, which passes through the holes 39 pierced in the tube 27 is flushed across the valve 40, flexible ring encircling the annular cylinder 35 pierced with the holes 41. If the introduction of the string is not completed or if it comes out following an accident it suffices to maneuver the cylinder 35 to assure its entry into the magazine.

Other combinations can be additionally provided for example:

in a variation on the FIG. 8 apparatus the annular chamber (e) can be replaced by an additional cylinder attached as in the FIG. 7.

the chamber (e) can be eliminated as well, this variation of FIG. 8 becomes then an integrated version of FIG. 6. This apparatus has the great advantage of being the least expensive and the least cumbersome; but it does not permit the repetition of the operation.

All kinds of valves, lights, piston joints and other materials can be used, springs can replace the elastic holders and vice versa and other apparatus giving the same results can be adopted.

The string that is generally a braid must preferably be of a round cross section and have the appropriate flexibility to be neither too soft so as not to curl up too short, nor too stiff so as not to rest in the space in question, the diameter of the cylinder being defined such that the piling of the figure eight and the spirals formed by the string will be ordered.

The bore of the endpiece must have dimensions assuring both the efficient drawing in of the string and its free passage. Different lengths, diameters and forms of the bore are possible, from a simple cylindrical hole to the most elaborate venturi. All depends on the desired. The endpiece can be screwed on or off for rapid assembly.

The orifices of the endpiece are preferably joined to the exterior conical forms by lips that are rounded but thin to facilitate the passage of the string by acting as a corner, disentangling the short accidental curls (FIG. 10).

By way of non-limiting example and to give an idea of the dimensions of the apparatus, a piston of diameter 23 mm, and 150 mm in length acting on a string of 2 mm across an endpiece of 2.3 mm assures the introduction of 5 meters of string. This length is approximately a third of the height of the column of water of diameter 2.3 and of volume equal to that of the cylinder.

The control of the storing can be linked to that of the extension of the holders of the weapon. For example, if the tube of the crossbow is composed of two telescopic tubes, which permits, by increasing the total length of the tube by the maneuver of a lever, to increase the strength of the holders while adding to the precision of the weapon, one can use the space created in the tube to pull in the string.

It is understood that the present disclosure of the preferred forms of the invention has been made only by way of examples and numerous changes in the detail of construction may be resorted to without departing from the spirit and scope of the invention as hereinafter claimed.

We claim:

1. A crossbow apparatus capable of use while submerged under water comprising:

a projectile operatively attached to said apparatus, a string attached at one end to said projectile, means for retracting said string, said means for retracting being attached to the other end of said string, a magazine in which said string normally reposes until the projectile is fired, and means to actuate said retracting means after the projectile is fired thus causing low pressure to develop in said magazine with subsequent withdrawing of said string due to water being withdrawn into said magazine.

2. The apparatus of claim 1 further comprising an enclosure and wherein said retracting means comprises a piston pump, said piston pump being located within said enclosure.

3. The apparatus of claim 2, wherein said magazine contains a hole at one end thereof, through which said string enters and exits.

4. The apparatus of claim 3, wherein said enclosure is said magazine, and wherein said piston pump comprises a piston head facing said one end of the magazine, and said string is attached to said piston head at the forward side thereof.

5. The apparatus of claim 4, wherein after firing of the projectile, means are provided for moving said piston pump to said one end of the magazine toward said hole, and at least another hole is provided at a location between said hole and said piston head within said magazine, to enhance ejection of water through said at least another hole.

6. The apparatus of claim 4, wherein said piston pump is restrained from forward movement toward said hole, by a spring attached to the piston head, and also a releasable catch that releases the pump when the projectile is fired.

7. The apparatus of claim 3, further comprising means for moving said piston pump to said one end of said magazine in a direction towards said hole.

8. The apparatus of claim 7, wherein said magazine is equipped with a check valve at the forward end thereof to assist in evacuation of water from said magazine when said piston pump moves to the forward end of said magazine.

9. The apparatus of claim 8 further comprising an elastic means, said elastic means being fixed at one end to said piston pump and adapted to be connected at another end to said crossbow apparatus, wherein said piston pump is restrained from forward movement when said another end of said elastic means is connected to said crossbow apparatus.

10. The apparatus of claim 4, wherein said piston head is equipped with a valve, which lets water pass freely into the magazine, when said piston head moves toward the forward end of the magazine, but closes when the piston head is retracted.

11. The apparatus of claim 1, wherein said crossbow apparatus is comprised of telescopic tubes wherein said magazine comprises a, hollow tube resulting from telescopic extension.

* * * * *

UNITED STATES PATENT AND TRADEMARK OFFICE

CERTIFICATE OF CORRECTION

PATENT NO. : 4,466,417

DATED : August 21, 1984

INVENTOR(S) : Georges MULOT et al.

It is certified that error appears in the above-identified patent and that said Letters Patent is hereby corrected as shown below:

Column 3, lines 23 and 24, change "and this" to ---that---.

Signed and Sealed this

*Sixteenth* Day of *April 1985*

[SEAL]

*Attest:*

DONALD J. QUIGG

*Attesting Officer* *Acting Commissioner of Patents and Trademarks*